US010533804B2

(12) United States Patent
Bardeleben et al.

(10) Patent No.: US 10,533,804 B2
(45) Date of Patent: Jan. 14, 2020

(54) HEAT EXCHANGERS HAVING HIGH DURABILITY

(71) Applicant: Dana Canada Corporation, Oakville (CA)

(72) Inventors: Michael J. R. Bardeleben, Oakville (CA); Noman Rahim, Brampton (CA); Thomas K. C. Chan, Oakville (CA); Joseph G. Ruthenberg, Port Huron, MI (US)

(73) Assignee: Dana Canada Corporation, Oakville, Ontario (CA)

( * ) Notice: Subject to any disclaimer, the term of this patent is extended or adjusted under 35 U.S.C. 154(b) by 193 days.

(21) Appl. No.: 15/722,542

(22) Filed: Oct. 2, 2017

(65) Prior Publication Data

US 2018/0094859 A1 Apr. 5, 2018

Related U.S. Application Data

(60) Provisional application No. 62/403,389, filed on Oct. 3, 2016.

(51) Int. Cl.
*F28D 1/03* (2006.01)
*F28F 9/02* (2006.01)

(52) U.S. Cl.
CPC ..... *F28D 1/0333* (2013.01); *F28F 9/0246* (2013.01); *F28F 2225/08* (2013.01)

(58) Field of Classification Search
CPC ..... F28D 1/0333; F28D 9/0043; F28F 3/027; F28F 9/0246; F28F 2225/08; F28F 2275/04
USPC ..... 165/76
See application file for complete search history.

(56) References Cited

U.S. PATENT DOCUMENTS

| | | | | |
|---|---|---|---|---|
| 4,881,594 | A | 11/1989 | Beamer et al. | |
| 5,794,691 | A * | 8/1998 | Evans | F28D 1/0333 165/153 |
| 5,875,834 | A * | 3/1999 | Brooks | F28D 1/0333 165/11.1 |
| 6,056,045 | A | 5/2000 | Matsuzaki et al. | |
| 6,364,006 | B1 * | 4/2002 | Halt | F28D 1/0333 165/148 |
| 6,550,249 | B2 | 4/2003 | Ponca et al. | |
| 7,051,799 | B2 | 5/2006 | Wu et al. | |
| 7,302,997 | B2 | 12/2007 | Kozdras et al. | |
| 7,681,313 | B2 | 3/2010 | Zurawel et al. | |

(Continued)

FOREIGN PATENT DOCUMENTS

GB 2275996 A 9/1994

OTHER PUBLICATIONS

International Search Report for PCT/CA2017/051169 (dated Jan. 8, 2018).

*Primary Examiner* — Justin M Jonaitis
(74) *Attorney, Agent, or Firm* — Ridout & Maybee LLP

(57) ABSTRACT

A heat exchanger having a plurality of heat exchanger plate pairs. Each plate has a longitudinal central planar portion and a peripheral edge portion extending from it. The plate is provided with a first boss and a second boss having an inlet and outlet, respectively. A rib is also provided extending from the peripheral edge portion to the central planar portion, the rib having a mating surface, where the rib mating surface of a first plate in a first plate pair is in contact with a rib mating surface of a second plate in an adjacent plate pair.

20 Claims, 10 Drawing Sheets

(56) References Cited

U.S. PATENT DOCUMENTS

| | | | | |
|---|---|---|---|---|
| 8,596,339 | B2 | 12/2013 | Palanchon | |
| 8,678,077 | B2 * | 3/2014 | Shore | F28D 1/0325 165/153 |
| 2008/0121382 | A1 * | 5/2008 | So | F28D 1/0333 165/140 |
| 2010/0018676 | A1 | 1/2010 | Yang et al. | |
| 2015/0034285 | A1 | 2/2015 | Graham | |

* cited by examiner

Prior-art

Prior-art

HEAT EXCHANGERS HAVING HIGH DURABILITY

FIELD

This specification relates to heat exchangers, and in particular to stacked plate heat exchangers, as used particularly in the automotive industry.

BACKGROUND

Stacked plate heat exchangers typically comprise a plurality of plate pairs stacked one on top of the other with each plate pair having opposed inlet and outlet openings such that when the plate pairs are stacked together, the inlet and outlet openings align to form inlet and outlet manifolds and thereby establish communication between fluid channels formed inside each plate pair. The plate pairs are usually joined together by brazing. However, as the plate pairs tend to be unsupported in the area of the manifolds, the heat exchanger in the area of the inlet and outlet openings tends to distort under the pressure of the fluid flowing therethrough and will often expand like an accordion or "bellows" in the manifold region. The distortion that occurs in the manifold regions of the heat exchanger tends to lead to premature failure or cracking and leaking in the heat exchanger.

Similarly, in in-tank oil coolers (ITOC) (cross-section of a portion of an ITOC is shown in FIG. 1), under internal oil pressure, the header expands primarily due to the force acting on the unsupported area of the bottom plate. Although turbulizers are present in the channel (though not shown in FIG. 1), the turbulizers end at the header bubble, and hence can only provide limited support to the header region. This expansion, similar to how a bellows would expand, leads to eventual failure in the core plate bubble under high pressure. This failure location is typically located either in the top or bottom channel due to the change in local stiffness because of the presence of the fitting and bottom reinforcement plate.

For applications that require higher durability, the core plate bubbles are replaced with washers (also referred to as spacers) as shown FIG. 2. The higher durability is achieved not only by the elimination of the bubbles but by extending the washer diameter such that it overlaps the area of the core plate to which the turbulizer brazes. This increases the vertical rigidity of the header region, making is less susceptible to vertical expansion under pressure. The drawback to such a design is that it makes it more complicated for assembly and increases the final cost of the part.

Another approach used to reinforce the inlet and outlet areas of a heat exchanger is to use exterior clamps or brackets that are brazed to the outside of the heat exchanger to keep it from expanding under pressure. Another further approach is to insert perforated or slotted tubes through all of the aligned inlet and outlet openings of each plate, the tubes being brazed to the peripheries of the respective inlet and outlet openings. However, such approaches as described above, can be costly and can increase overall manufacturing process and costs associated with the particular heat exchanger.

U.S. Pat. No. 5,794,691 (Evans et al.) discloses a heat exchanger made from a plurality of stacked plate pairs wherein the inlet and outlet openings that form the manifolds include opposed flange segments formed on the inner peripheral edges of the openings. The flange segments extend inwardly and are joined together when the plates are stacked together to prevent expansion of the manifolds when under pressure.

U.S. Pat. No. 8,678,076 B2 (Shore et al.) discloses a plate type heat exchanger having a plurality of stacked plate pairs. Each plate pair has opposed manifold members with respective inlet and outlet openings that are in registration to form respective inlet and outlet manifolds for the flow of a first fluid through a first set of fluid channels formed by the plate pairs. The manifold members spacing the plate pairs apart to form a second set of transverse flow channels for the flow of a second fluid. Each plate has a peripheral edge portion which seals the plates together to form the first set of fluid channels therebetween. A protrusion member is formed proximal to each of the manifold members, each protrusion member having a mating surface such that the protrusion members on the second plate of one plate pair align and abut with the protrusion members on the first plate of an adjacent plate pair thereby reinforcing and strengthening the manifold region of the heat exchanger to prevent the deformation or accordion of the manifold under pressure.

There is a need in the art for heat exchanger plates that can help to form a rigid structure along the height of the heat exchanger that allows the bottom and top core plates to better withstand the pressure load of a fluid flowing therethrough. In addition, there is a need in the art for a heat exchanger plate that can to eliminate the need to use washers between core plates in the header region and to increase the burst strength of the heat exchanger. Further, there is a need in the art for a heat exchanger having such heat exchanger plates.

BRIEF DESCRIPTION OF THE DRAWINGS

Reference will now be made, by way of example, to the accompanying drawings which show example embodiments of the present application, and in which:

FIG. 8(*b*) shows cross-sectional side views of header portion of an embodiment of a heat exchanger having washers in between plate pairs;

FIG. 9(*b*) shows a top plan view of a portion of another embodiment of a heat exchanger plate in accordance with the specification;

FIG. 9(*c*) shows a top plan view of a portion of another embodiment of a heat exchanger plate in accordance with the specification;

FIG. 9(*d*) shows a top plan view of a portion of another embodiment of a heat exchanger plate in accordance with the specification;

FIG. 9(*e*) shows a top plan view of a portion of another embodiment of a heat exchanger plate in accordance with the specification;

FIG. 9(*f*) shows a top plan view of a portion of another embodiment of a heat exchanger plate in accordance with the specification.

Similar reference numerals may have been used in different figures to denote similar components.

SUMMARY OF INVENTION

In one aspect, a reinforcing rib is formed in the header portion (inlet and outlet manifolds) of the heat exchanger plate. In particular, the reinforcing rib is positioned between a boss having the inlet (or outlet) and the peripheral edge of the heat exchanger plate. Preferably, the reinforcing rib extends from the central planar portion of the heat exchanger plate around the boss having the inlet (or outlet) to the peripheral edge portion of the heat exchanger plate, with the reinforcing rib being in contact with the peripheral edge portion.

In another aspect, a heat exchanger plate pair is disclosed having the reinforcing rib as described above.

In another further aspect, the heat exchanger plate pair is disclosed having the reinforced rib as described herein and a turbulizer positioned in a fluid channel defined by the plate pair. The turbulizer extending from one peripheral edge portion of the heat exchanger plate having the inlet (from the narrow edge of the longitudinal heat exchanger plate) to the opposing peripheral edge portion of the heat exchanger plate (to the other the narrow edge of the longitudinal plate) having the outlet. In a particular embodiment, the turbulizer has an aperture, with the edge of the aperture being generally aligned with the edge of the inlet (or outlet).

In still another aspect, the specification relates to a heat exchanger having a heat exchanger plate pair with the plate having the reinforcing rib as described above. The heat exchanger is also provided with a fitting that engages the inlet and outlet of the heat exchanger. Further, the peripheral edge portion of the fitting also engages the reinforcing rib of the top heat exchanger plate to help provide a more rigid structure along the height of the heat exchanger.

DESCRIPTION OF EXAMPLE EMBODIMENTS

Figure 1:
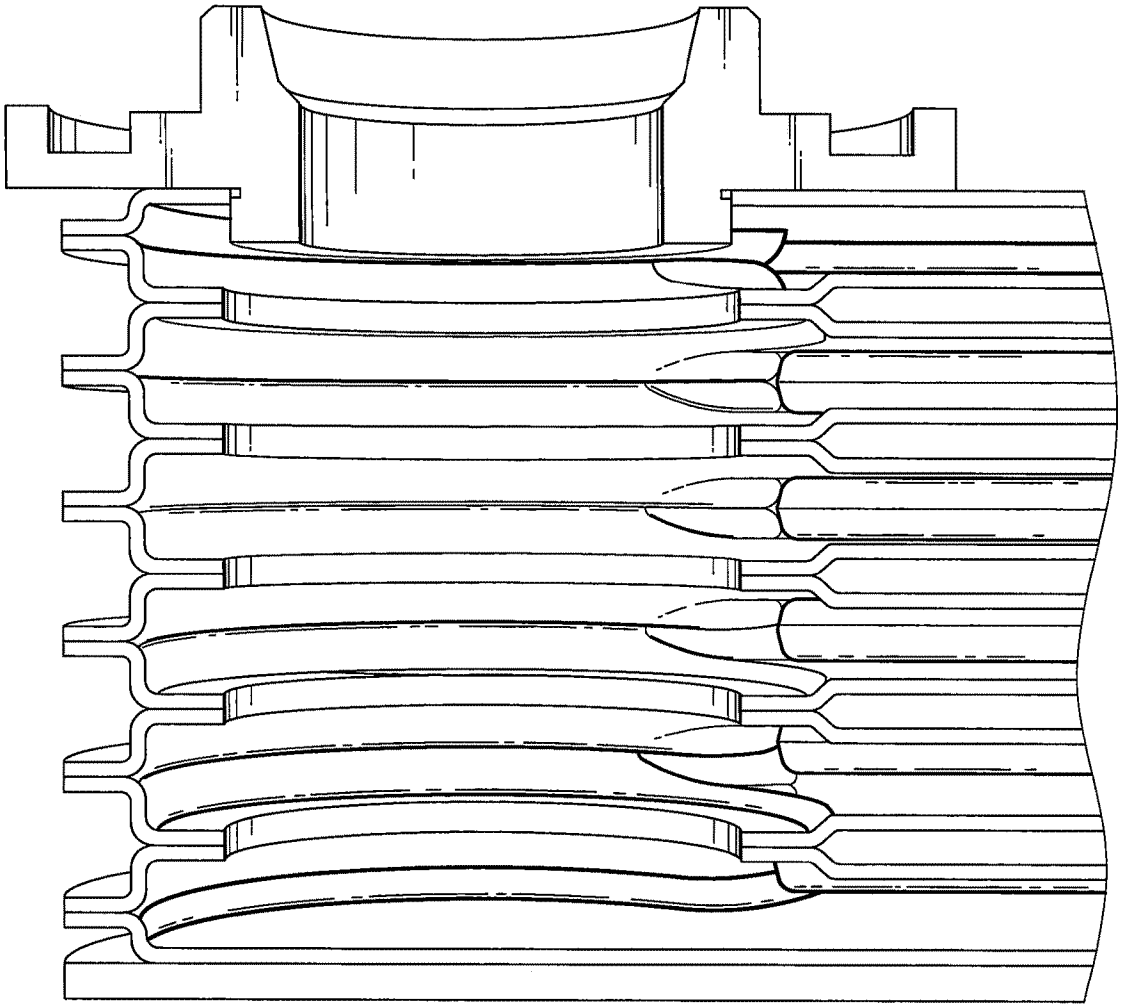
FIG. 1 shows cross-sectional side view of a portion of an embodiment of an in-tank oil cooler (ITOC)
Figure 2:
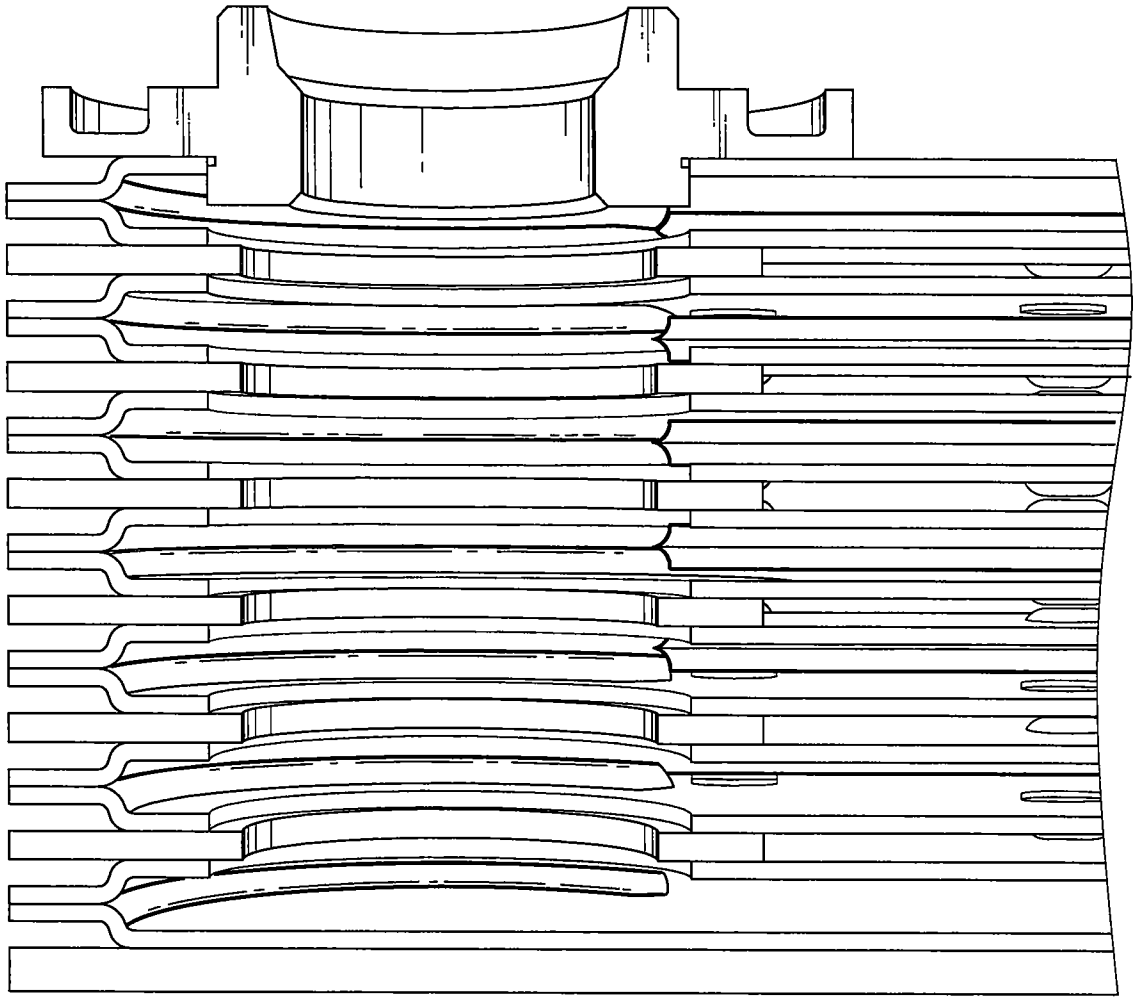
FIG. 2 shows cross-sectional side view of a portion of another embodiment of an in-tank oil cooler (ITOC) having washers (or spacers)
Figure 3:
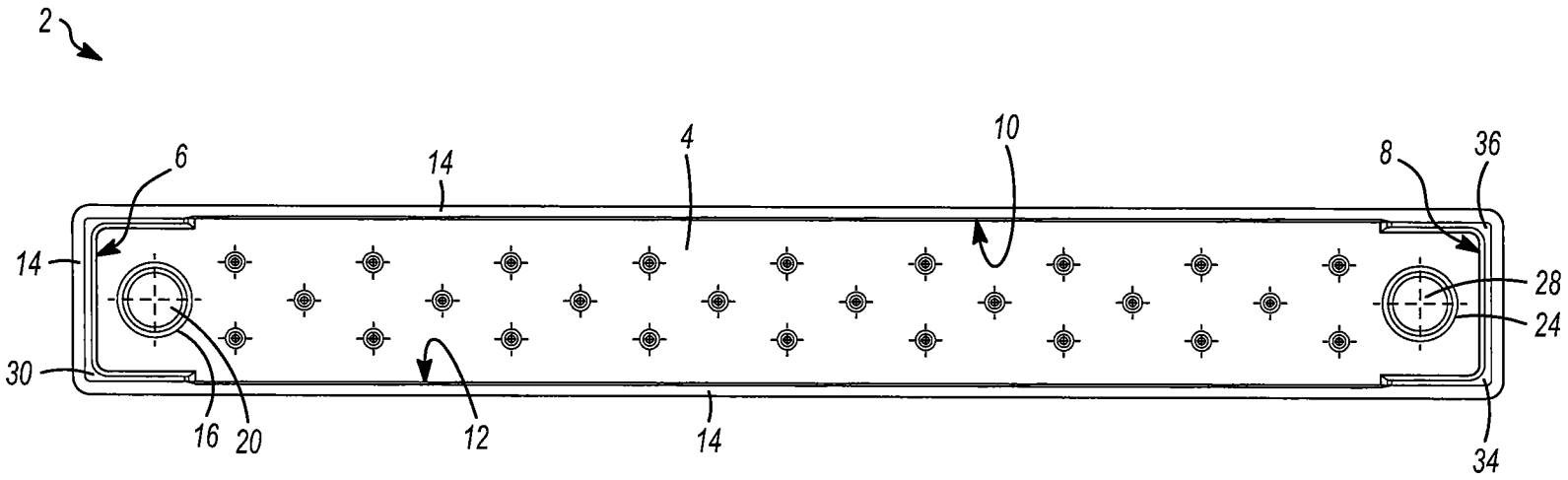
FIG. 3 shows a plan view of heat exchanger plate in accordance with the specification.

FIG. 3 discloses a plan view of a heat exchanger plate 2 in accordance with an embodiment disclosed herein. The heat exchanger plate 2 has a central planar portion 4. In the embodiment shown, the heat exchanger plate 2 is generally rectangular; however, other shapes are also possible depending upon design and application requirements. The heat exchanger plate 2 has a longitudinal central planar portion 4, that has a first end 6, a second end 8, a third end 10 and fourth end 12; which relate to the different sides of the heat exchanger plate 2. Hence, the first end 6 and second end 8 are opposed to each other and are at the narrow edge of the heat exchanger plate 2. Similarly, the third end 10 and fourth 12 are also opposed to each other, and extend from the first end 6 to the second 8. The third end 10 and the fourth end 12 therefore define the longitudinal edge of the central planar portion 4.

The heat exchanger plate 2 is also provided with a peripheral edge portion 14 that extends from the longitudinal central portion 4 on all sides of the heat exchanger plate 2. Hence, the peripheral edge portion 14 extends from the first end 6, the second end 8, the third end 10 and the fourth end 12 of the longitudinal central planar portion 4. As is described herein, the peripheral edge portions 14 of two plates come in contact to form a plate pair, when the plates 2 are positioned in a face-to-face relationship, and help define a fluid channel. To achieve this, the peripheral edge portion 14 is present in a different plane than the central planar portion 4 of the heat exchanger plate 2. For instance, the peripheral edge portion 14 can be considered to be below the central planar portion 4. For purposes of description, the central planar portion is present in first plane, while the peripheral edge portion 14 is present in a second plane.

The heat exchanger plate 2 has a first boss (or bubble) 16 near the first end 6 of the central planar portion 4. The first boss 16 extends in a direction opposite to the peripheral edge portion 14. In one embodiment, as shown in the figures, the first boss 16 has a generally flat surface, denoted herein as a first boss contact surface 18, which lies in a different plane (third plane) than the central planar portion 4 and the peripheral edge portion 14. When viewed from the side, in one view of the heat exchanger plate 2, the central planar portion 4 (that lies in the first plane) is in between the peripheral edge portion 14 (that lies in the second plane) and the first boss contact surface 18, which lies in the third plane. The first boss contact surface 18 has inlet opening 20 to permit fluid to enter into the heat exchanger 22. As described herein, the first boss contact surface 18 engages the contact surface of a boss on an adjacent plate pair to form the inlet manifold.

In addition to the above, the heat exchanger plate 2 also has a second boss (or bubble) 24 near the second end 8 of the central planar portion 4. Like the first boss 16, the second boss 24 extends in a direction opposite to the peripheral edge portion 14 (and in the same direction as the first boss 16). Similar to the first boss 16, the second boss 24 has a generally flat surface, denoted herein as a second boss contact surface 26, which also lies the third plane (same as the first boss contact surface 18). The second boss contact surface 26 has outlet opening 28 to permit fluid to exit from the heat exchanger 22. As described herein, the second boss contact surface 26 engages the contact surface of a boss on an adjacent plate pair to form the outlet manifold.

In accordance with an embodiment disclosed in FIG. 3, the heat exchanger plate 2 is provided with a first reinforcing rib 30 at the first end of the central planar portion 4 (denoted herein as the first end first reinforcing rib). The first reinforcing rib 30 extends from the central planar portion 4 at the first end 6 in the same direction as the first boss 16, and is coupled to the peripheral edge portion 14. In other words, the first end first reinforcing rib 30 extends from the peripheral edge portion 14 at the first end 6 to the central planar portion 4. In one embodiment, as disclosed herein, the entire reinforcing rib 30 is in contact with the peripheral edge portion 14, while in other embodiments, only a portion of the reinforcing rib 30 is in contact with the peripheral edge portion 14.

The first end first reinforcing rib 30 is also provided with a first end first rib mating surface 32. The first end first rib mating surface 32 also lies in the third plane, with the first boss contact surface 18 and the second boss contact surface 26. When the heat exchanger 22 is assembled, the rib 30 on one plate engages a rib 30 on another plate in an adjacent plate pair. This can help to reinforce the header section of the heat exchanger 22.

Also provided (as shown in FIG. 3) a second end first reinforcing rib 34 at the second end 8 of the central planar portion 4 (denoted herein as the second end first reinforcing rib). The second end first reinforcing rib 34 extends from the central planar portion 4 at the second end 8 in the same direction as the second boss 24, and is coupled to the peripheral edge portion 14. In other words, the second end first reinforcing rib 34 extends from the peripheral edge portion 14 at the second end 8 to the central planar portion 4. The second end first reinforcing rib 34 is also provided with a second end first rib mating surface 36. The second end first rib mating surface 36 also lies in the third plane, with the first boss contact surface 18 and the second boss contact surface 26. Analogous to the first end first reinforcing rib 30, when the heat exchanger 22 is assembled, the second end rib 34 on one plate engages a second end rib 34 on another plate in an adjacent plate pair.

Figure 4:
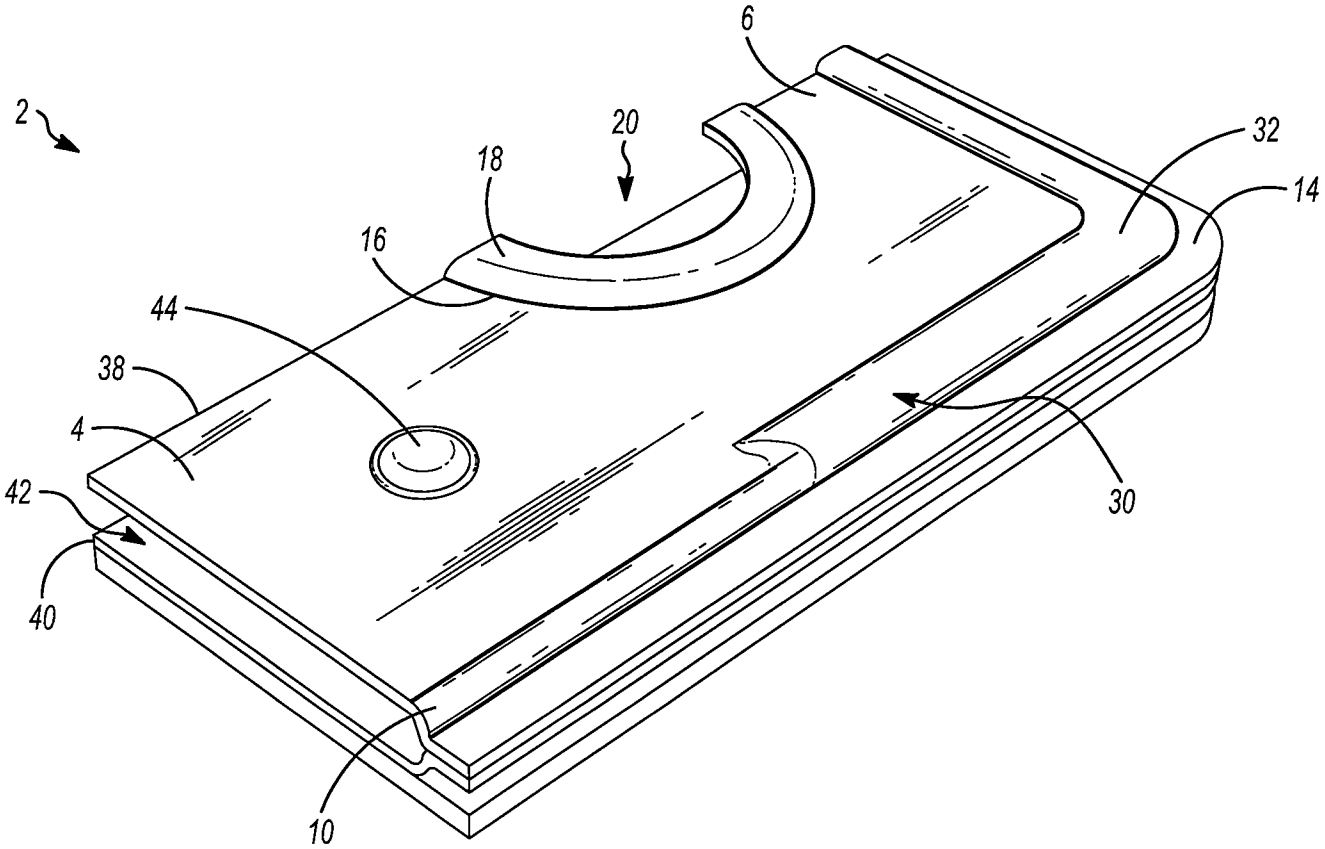
FIG. 4 shows cross-sectional perspective view of a header portion of a heat exchanger plate pair in accordance with the specification.

FIG. 4 shows a cross-sectional perspective view of a header portion of a heat exchanger plate pair in accordance with the specification. As shown, the plate pair is formed by a first plate 38 and a second plate 40 that are positioned in a face-to-face relationship. The peripheral edge portions 14 of the two plates (first plate 38 and second plate 40) come in contact to define a first fluid flow channel 42 that permits a fluid entering the inlet 20 to flow through the plate pair. Typically, as should be known to a person of ordinary skill in the art, the first plate 38 is identical to the second plate 40, although in some embodiments they may be different.

In a particular embodiment, as shown in FIG. 4, the heat exchanger plate 2 is provided with dimples 44 that can help to provide further structural support to the heat exchanger plate 2. The number, position and size of the dimple 44 is not particularly limited and can vary depending upon design and application requirements. In one embodiment, for example as shown in FIG. 4, the dimple 44 is positioned close to the boss (first boss 16 or second boss 24). In another embodiment, as described herein, multiple dimples 44 are provided.

Figure 5:
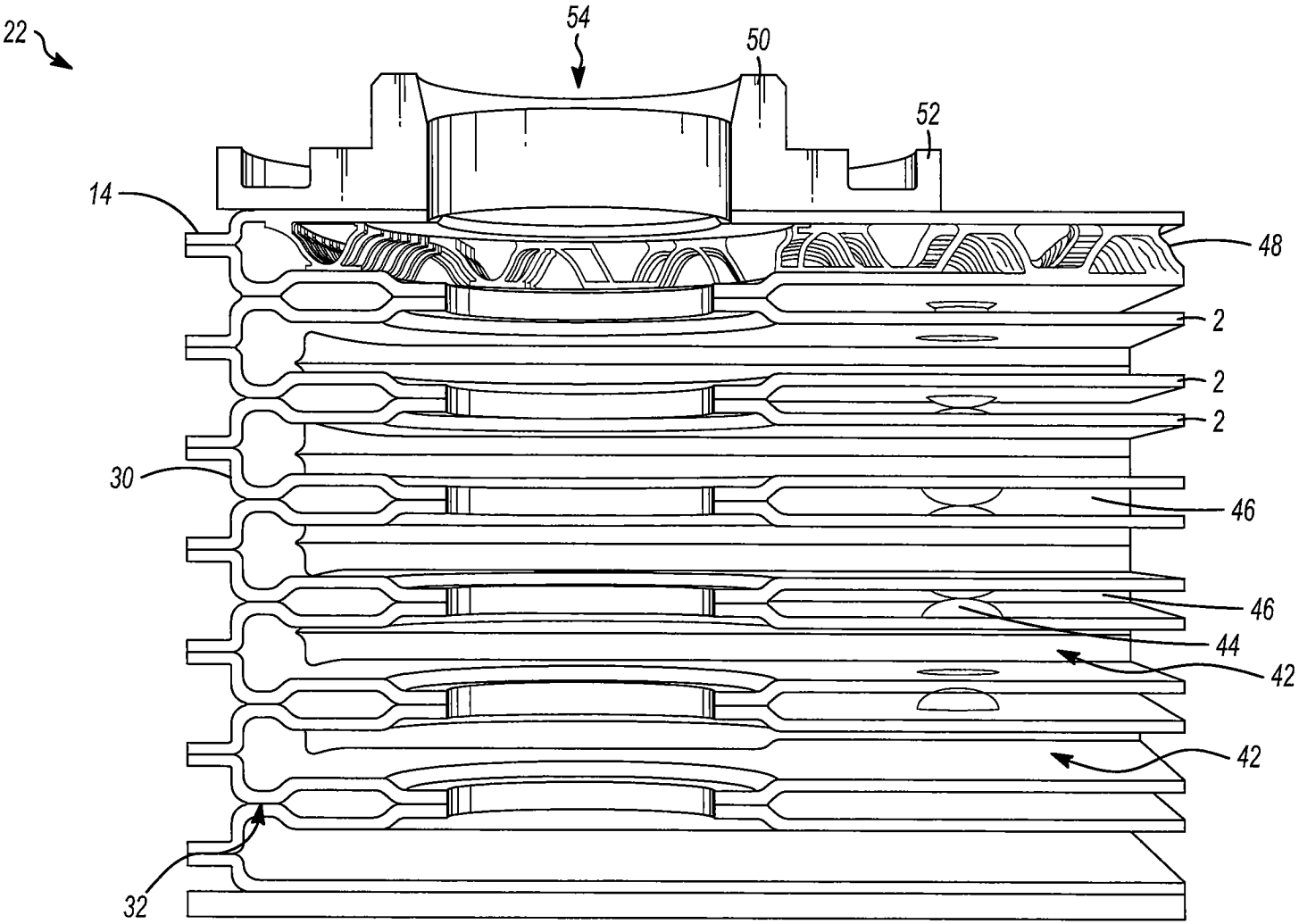
FIG. 5 shows cross-sectional side view of a header portion of another embodiment of a heat exchanger in accordance with the specification.
Figure 6:
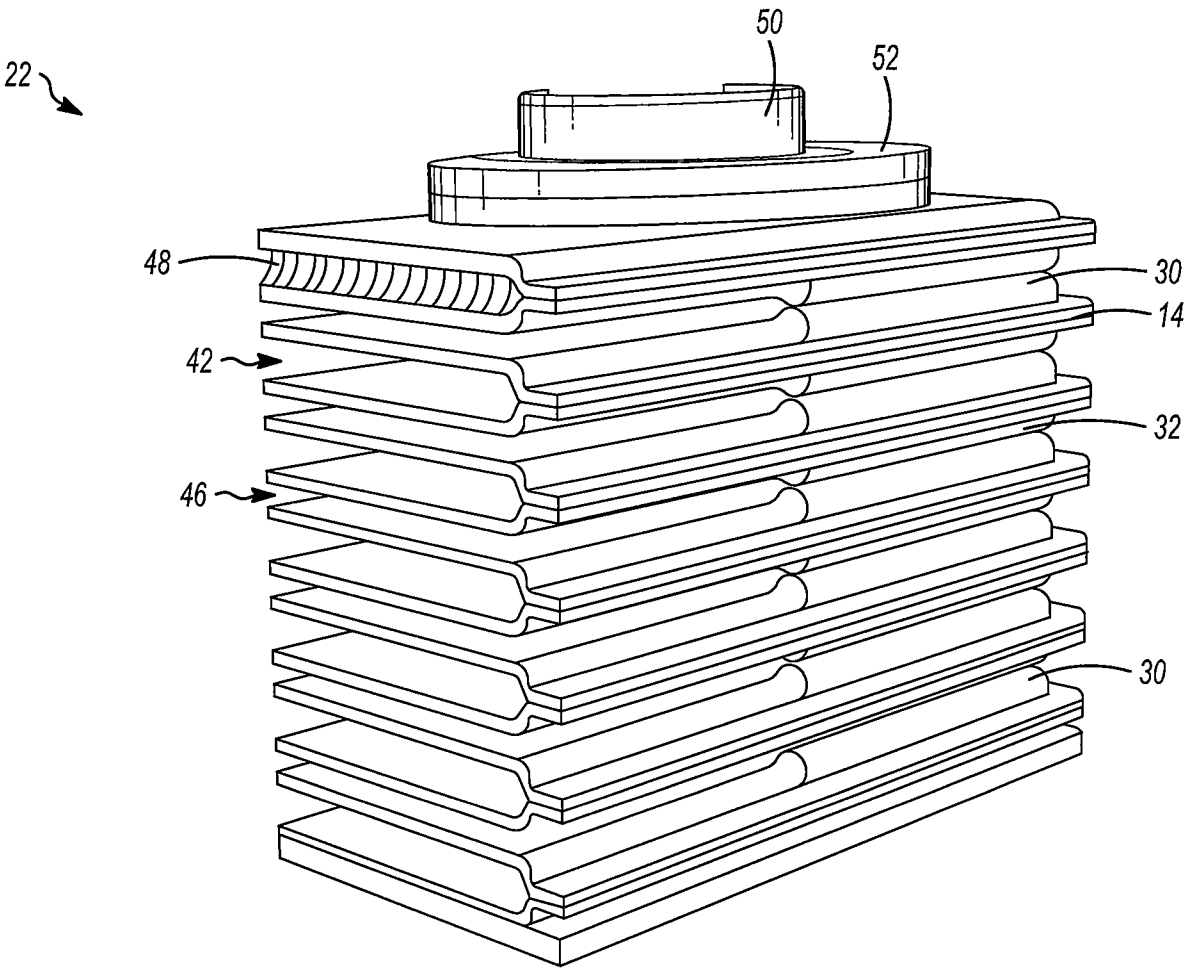
FIG. 6 shows cross-sectional perspective view of a header portion of a heat exchanger in accordance with the specification.

FIGS. 5 and 6 show cross-sectional views of a header portion of further embodiments of heat exchangers 22 in accordance with the specification. The heat exchanger 22 is provided with a plurality of heat exchanger plates 2. Each plate 2 of the plate pair is present in a face-to-face relationship, with the plate pairs together defining the first fluid flow channel 42. Adjacent plate pairs are spaced apart from one another and define a second fluid flow channel 46 for flow of a second fluid, with which heat exchange takes place.

As described herein, particularly with respect to FIGS. 3 and 4, the heat exchanger 22 is provided with heat exchanger plates pairs 2 having a first plate, where the peripheral edge portion 14 of the first plate engages with the peripheral edge portion of the second plate in the plate pair. The heat exchanger plates 2 are also provided with reinforcing ribs 30 that can help to provide strength and rigidity in the header portion of the heat exchanger 22. The reinforcing ribs 30 have a reinforcing rib mating surface 32, where the reinforcing rib mating surface 32 of a first plate engages with the reinforcing rib mating surface 32 of a second plate of an adjacent plate pair (as shown in FIGS. 5 and 6).

As more clearly shown in FIG. 5, dimples 44 are also provided on the central planar portion 4. Similar to the reinforcing rib mating surface 32, the dimples 44 of a first plate engage with dimples 44 of a second plate of an adjacent plate pair.

In one embodiment, as shown in FIG. 5, the heat exchanger plate pairs are provided with a turbulizer 48. Although, FIGS. 5 and 6 only show a turbulizer 48 present in the top plate pair, as should be recognized a person of ordinary skill in the art, a plurality of plate pairs can be provided with the turbulizer 48 or a all the plate pairs can be provided with the turbulizer 48. In accordance with an embodiment disclosed herein, the design of the heat exchanger plate 2 and the presence of the reinforcing ribs 30, allows the turbulizer 48 to extend all the way to the first end 6 (or second end 8) of the heat exchanger plate pair. This allows the turbulizer 48 to be present in between the space defined by the reinforcing ribs 30 in a plate pair, and also contact the internal surface of the heat exchanger plate pair that extends to form the peripheral edge portion 14.

The heat exchanger 22 also has a fitting 50 that couples to a top heat exchanger plate 2. In one embodiment, the top plate and/or the bottom plate of the heat exchanger is a flat plate. In other words, a plate lacking the reinforcing ribs disclosed herein. Alternatively, in another embodiment, the top plate and/or the bottom plate of the heat exchanger can have the reinforcing ribs as disclosed herein. The fitting 50 has an orifice 54 that is in fluid communication with the inlet 20 (or outlet 28) of the top heat exchanger plate 2. In one embodiment, as shown in FIGS. 5 and 6, the fitting 50 has a peripheral edge portion that engages the reinforcing rib 30 of the top heat exchanger plate 2. Alternatively, the fitting 50 of the heat exchanger 22 is designed to allow the reinforcing ribs 30 to be within the perimeter of the fitting 50; which can help with further reinforcement of the heat exchanger 22. In one embodiment, as shown in FIGS. 5 and 6, the peripheral edge portion 52 of the fitting 50 overlays the reinforcing ribs 30 on the first end of heat exchanger plates (with or without the flat heat exchanger plate in between). In another embodiment, the peripheral edge portion 52 of the fitting 50 overlays the reinforcing ribs 30 on the first end, the third end and the fourth end of heat exchanger plates (with or without the flat heat exchanger plate in between).

Figure 7:
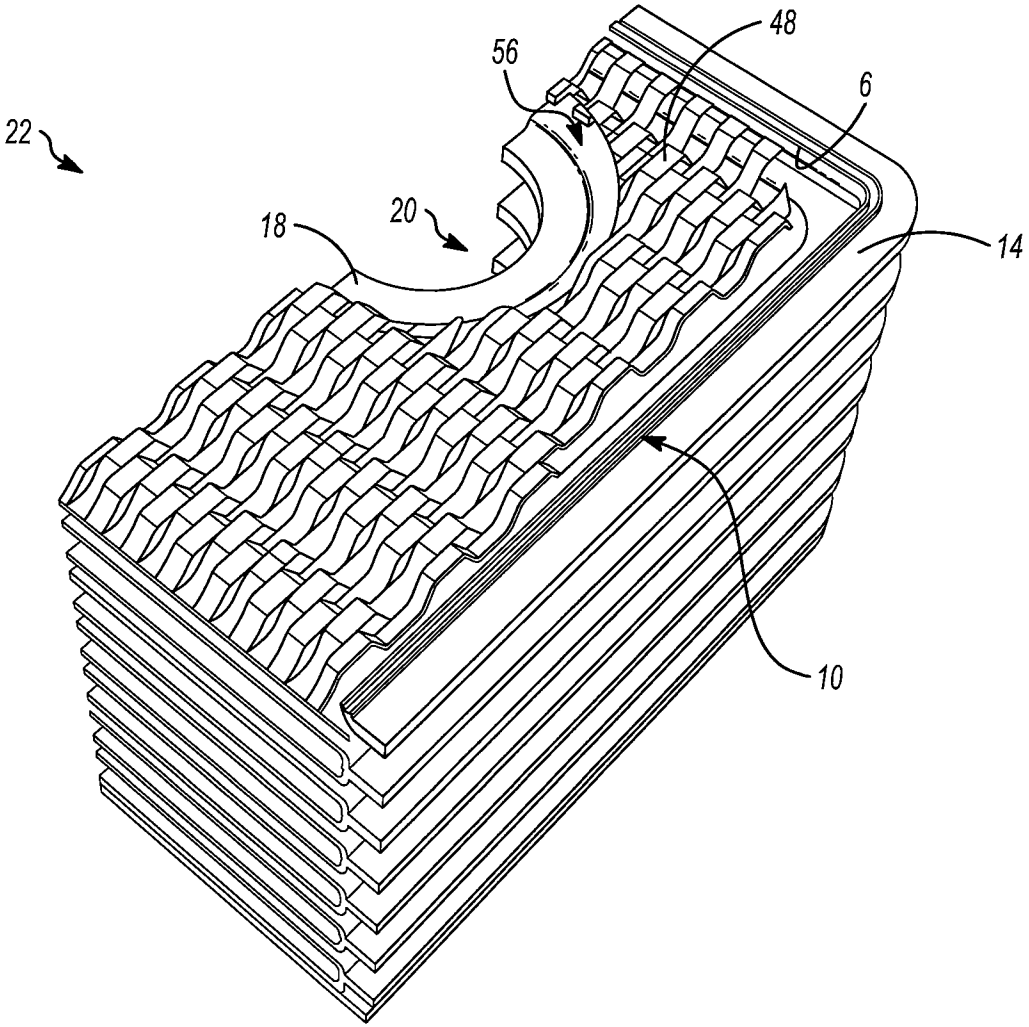
FIG. 7 shows cross-sectional top perspective view of a header portion of a heat exchanger without the top plate in accordance with the specification.

FIG. 7 shows cross-sectional top perspective view of a header portion of a heat exchanger without the top plate in accordance with an embodiment disclosed herein. As can be seen, the turbulizer 48 extends all the way to the first end 6 of the central planar portion 4 of the heat exchanger plate 2. Moreover, turbulizer 48 also extends to the second end 8, third end 10 and fourth end 12 of the central planar portion 4; and can be near or in contact with the inner wall of the heat exchanger plate pairs that extend to form the peripheral edge portion 14. In a particular embodiment, as shown in FIG. 7, the turbulizer 48 has an aperture 56, where the edge of the aperture 56 is generally aligned with the edge of the first boss defining the inlet 20 (or outlet) of the heat exchanger plate 2; thus allowing fluid to flow through the inlet 20.

Figure 8A:
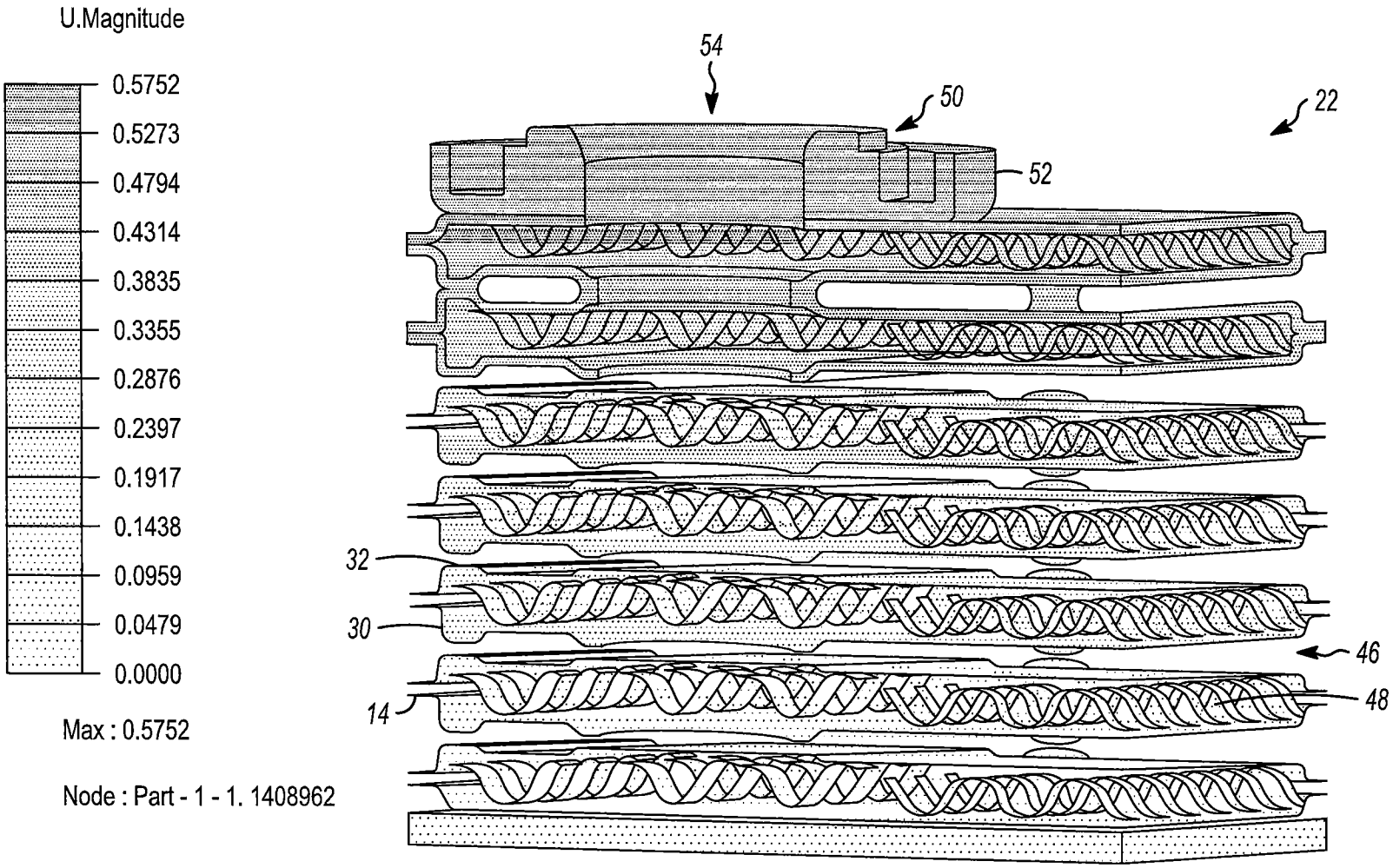
FIG. 8(*a*) shows cross-sectional side views of header portion of an embodiment of a heat exchanger in accordance with the specification.
Figure 8B:
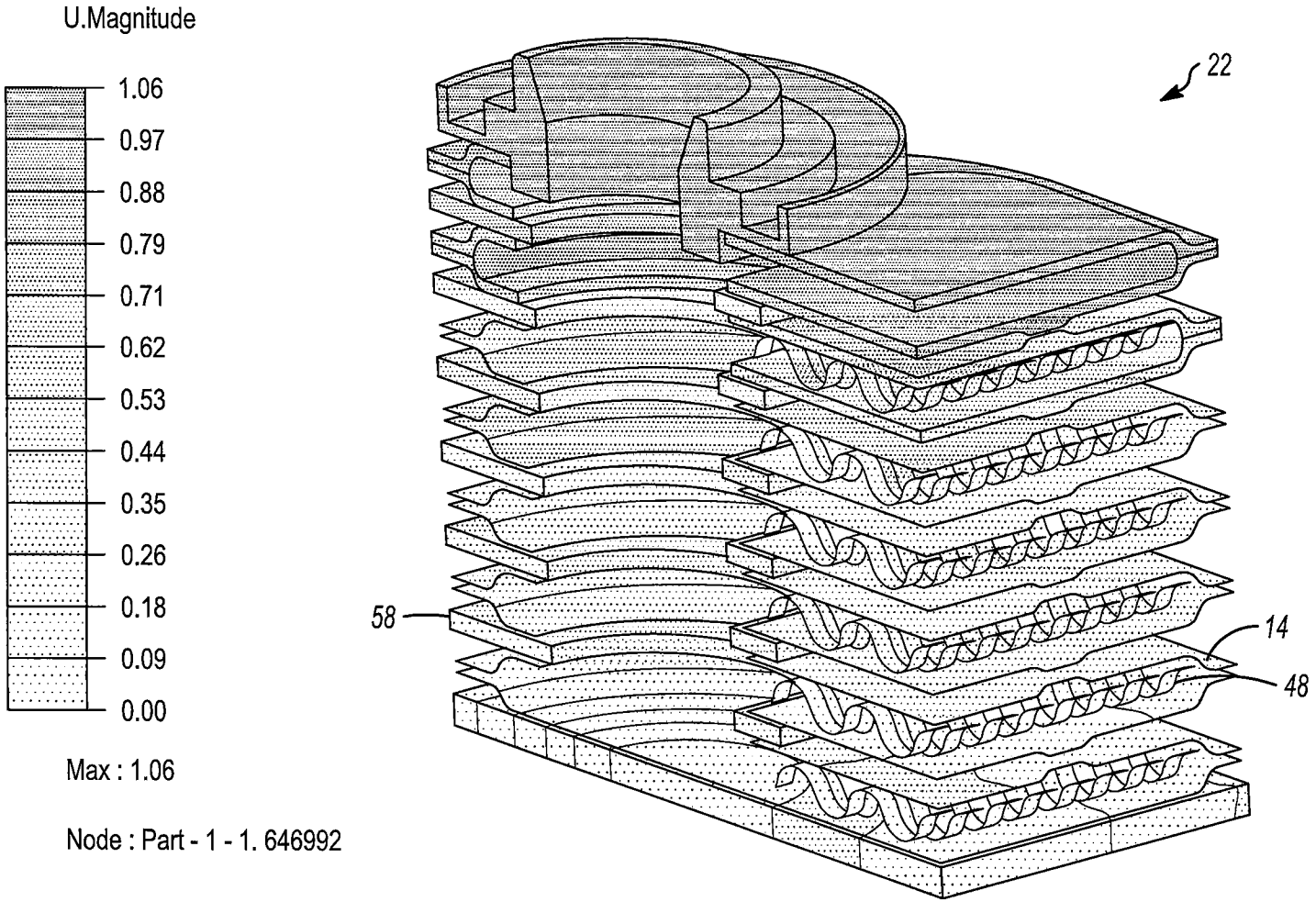

FIG. 8 shows cross-sectional side views of header portions of an embodiment of a (a) heat exchanger in accordance with the specification, and (b) a heat exchanger having washers in between plate pairs. The heat exchanger 22 (FIG. 8*a*) is similar to the heat exchanger 22 shown in FIG. 5. As seen in the FIGS. 8*a* and 8*b*, a turbulizer 48 is present in all plate pairs forming the heat exchanger 22. Further, in the embodiment shown in FIG. 8*b*, a washer 58 is provided between plate pairs to further enhance the strength of the header section of the heat exchanger 22. The heat exchanger 22 shown in FIG. 8*a* can help to prevent deformation of the header portion analogous to the heat exchanger (FIG. 8*b*) having the washer. However, as shown in FIG. 8, the presence of the reinforcing ribs 16 can significantly help to reduce the pressure sensed at the peripheral edges of the plate pairs near the inlet and outlet. As fluid enters through the fitting inlet, the highest pressure is sensed by the upper plate pairs, with the pressure sensed by the plate pairs diminishing as the fluid flows down in the fluid inlet manifold. With the lowest plate pair being noted as zero pressure, for purposes of reference, as shown in FIG. 8*a*, the pressure sensed by the top plate pair of the heat exchanger having reinforcing ribs 16 has a magnitude of 0.5752. In contrast, the pressure sensed by the top plate pair of the heat exchanger having washers (FIG. 8*b*) ranges from 0 to 1.06. Hence, the presence of the reinforcing ribs 16 can significantly reduce the pressure on the plate pairs and help to avoid deformation of the plate pairs near the inlet manifold.

FIG. 9 shows top plan views of a portion of a heat exchanger plate showing different embodiments of reinforcing ribs 30 in accordance with the specification. In one embodiment, as shown in FIGS. 9*a*-9*d*, the reinforcing ribs 30 have a generally U-shaped structure. In such embodiments, the reinforcing rib 30 is also in contact with the third end 10 and fourth end 12 of the heat exchanger plate 2. Hence, in one embodiment, the first end first reinforcing rib 30 also extends from the peripheral edge portion 14 at the third end to the central planar portion 4.

Figure 9A:
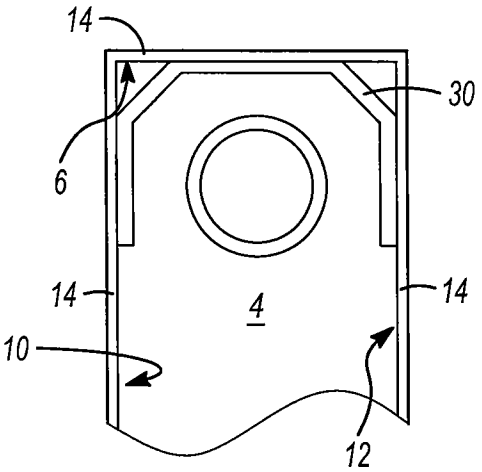
FIG. 9(*a*) shows a top plan view of a portion of another embodiment of a heat exchanger plate in accordance with the specification.
Figure 9B:
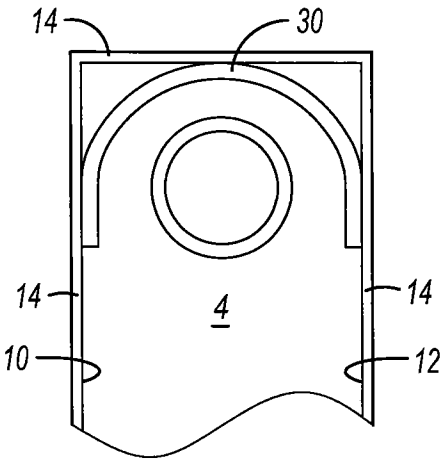
Figure 9C:
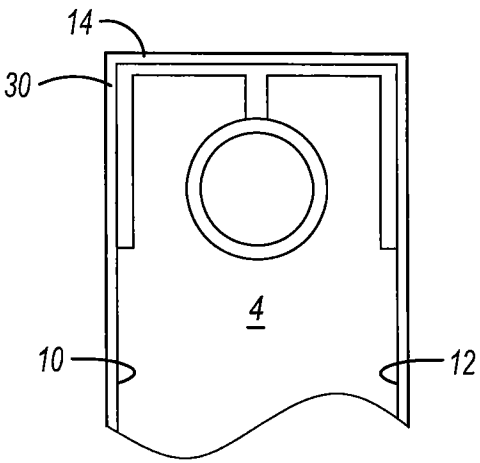
Figure 9D:
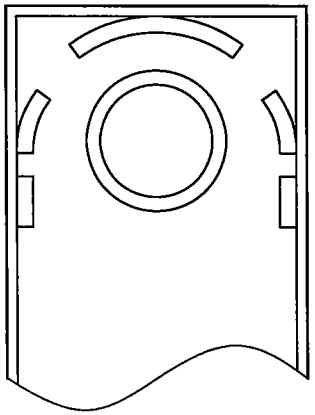
Figure 9E:
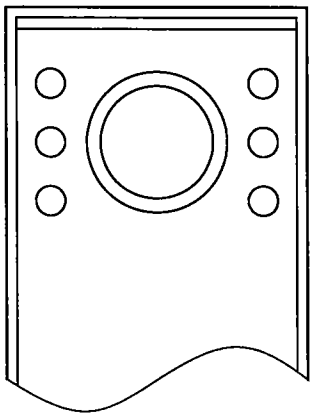
Figure 9F:
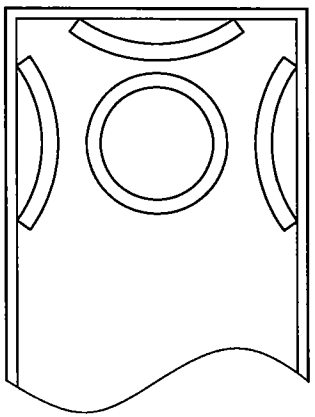

In an alternate embodiment, as shown in FIG. 9*e*, the reinforcing rib 30 can be formed along the length of the first end 6 of the central planar portion 4, from the third end 10 to the fourth end 12. Alternatively, the reinforcing rib 30 can have an arcuate profile as shown in FIG. 9*f*, with the rib 30 extending from the peripheral edge portion 14 inwards in the on the central planar portion 4. In the embodiment shown if FIG. 9*f*, the concave face of the rib 30 is towards the peripheral edge portion 14, however, as should be recognized, this can be reversed with the concave face towards the first boss.

The reinforcing rib 30 can be formed as a single rib as shown in FIGS. 9*a*-9*c* and 9*e*. Alternatively, the reinforcing rib is formed by a plurality of rib portions as shown in FIGS. 9*d* and 9*f*, which together function to provide the reinforcement. Furthermore, a reinforcing rib 30 can also be provided at the second end 8 of the central planar portion 4. The reinforcing ribs 30 on the first end 6 can be the same or different from the reinforcing ribs 30 at the second end 8.

The heat exchanger disclosed herein helps to increase the vertical rigidity of the header region, making is less susceptible to vertical expansion under pressure; while also helping to avoid use of washers.

In addition, the extended turbulizer can help to increase the oil side stiffness of the channels. The rib can help to increase the coolant side stiffness with the additional braze contact around the perimeter of the core plate under the fitting, eliminating the forcing moment that is applied to the core plate bubble as the bottom plate is pushed downwards by the oil pressure. The reaction force from the downward force of the oil is now transmitted up through the header to the fitting, and the overall effect is to reduce the deformation in the heat exchanger (as shown in FIG. 8) and lowering the stress.

Another benefit of this design is that it can help to reduce the oil side pressure drop. With the additional support provided by the rib, the internal diameter (ID) of the header bubble can be reduced as well. Having this diameter match the fitting diameter eliminates the pressure loss associated with sudden changes in cross sectional area of the flow path. Therefore, such heat exchangers 22 can also have a lower oil side pressure drop than conventional designs for the same turbulizer design.

Certain adaptations and modifications of the described embodiments can be made. Therefore, the above discussed embodiments are considered to be illustrative and not restrictive.

PARTS LIST

| No. | Description |
|---|---|
| 2 | Heat exchanger plate |
| 4 | central planar portion |
| 6 | first end of central planar portion |
| 8 | second end of 4 |
| 10 | a third end of 4 |
| 12 | fourth end of 4 |
| 14 | peripheral edge portion |
| 16 | first boss |
| 18 | first boss contact surface |
| 20 | inlet opening |
| 22 | Heat exchanger |
| 24 | Second boss |
| 26 | Second boss contact surface |
| 28 | Outlet opening |
| 30 | Rib |
| 32 | first end first rib mating surface |
| 34 | second end first reinforcing rib |
| 36 | $2^{nd}$ end first rib mating surface |
| 38 | first plate |
| 40 | second plate |
| 42 | first fluid flow channel |
| 44 | Dimple |
| 46 | Second fluid flow channel |
| 48 | Turbulizer |
| 50 | Fitting |
| 52 | Fitting peripheral edge portion |
| 54 | Orifice |
| 56 | Aperture |
| 58 | Washer |

What is claimed is:

1. A heat exchanger comprising:

a plurality of heat exchanger plate pairs, at least one plate pair having a first plate and a second plate, the first plate being identical and in face to face contact with the second plate, and the first plate and second plate having:

a longitudinal central planar portion having a first end, a second end, a third end and a fourth end, the third end being opposed to the fourth end, with the third end and fourth end extending from the first end to the second end; the central planar portion being in a first plane;

a peripheral edge portion extending from the first end, the second end, the third end and fourth end of the central planar portion; the peripheral edge portion being in a second plane;

a first boss extending from the central planar portion proximate to the first end; the first boss having a first boss contact surface being in a third plane and defining an inlet;

a second boss extending from the central planar portion proximate to the second end; the second boss having a second boss contact surface being in the third plane and defining an outlet; and a first end first rib extending from the peripheral edge portion at the first end to the central planar portion, the first end first rib contacting the third end and fourth end of the central planar portion, the first end first rib having a first end first rib mating surface being in the third plane;

wherein the first plane is in between the second plane and third plane; and the first end first rib mating surface of the first plate in a first plate pair being in contact with a first end first rib mating surface of a second plate in an adjacent plate pair; and the first boss contact surface of the first plate in the first plate pair being in contact with a first boss contact surface of the second plate in the adjacent plate pair.

2. The heat exchanger according to claim 1, wherein the first end first rib is formed as a single rib or by a plurality of ribs.

3. The heat exchanger according to claim 1, further comprising a fitting, the fitting having a peripheral edge portion that overlays the reinforcing ribs.

4. The heat exchanger according to claim 1, wherein the first end first rib has a generally U-shaped structure.

5. The heat exchanger according to claim 3, wherein the first end first rib is formed by a plurality of rib portions, each of the plurality of rib portions having an arcuate profile, with the concave face of one of the rib portions of the plurality of rib portions facing the first end of the central planar portion and the concave face of second and third rib portions of the plurality of rib portions facing the third end and the fourth end of the central planar portion.

6. The heat exchanger according to claim 1, further comprising a second end first rib.

7. The heat exchanger according to claim 6, wherein the second end first rib is formed as a single rib or by a plurality of second rib portions.

8. The heat exchanger according to claim 6, wherein the rib or ribs at the first end are identical to the rib or ribs at the second end.

9. The heat exchanger according to claim 1, wherein the first plate and the second plate of a plate pair together define a fluid passage, and further comprising a turbulizer positioned in the fluid passage and extending from the first end to the second end of the central planar portion.

10. The heat exchanger according to claim 9, wherein the turbulizer has an aperture, the edge of the turbulizer defining the aperture being generally aligned with the edge of the first boss contact surface defining the inlet.

11. The heat exchanger according to claim 1, further comprising one or more dimples on the central planar portion.

12. The heat exchanger according to claim 11, wherein the dimples are positioned proximate to the first boss and/or second boss.

13. A heat exchanger plate comprising:

a longitudinal central planar portion having a first end, a second end, a third end and a fourth end, the third end being opposed to the fourth end, with the third end and fourth end extending from the first end to the second end; the central planar portion being in a first plane;

a peripheral edge portion extending from the first end, the second end, the third end and fourth end of the central planar portion; the peripheral edge portion being in a second plane;

a first boss extending from the central planar portion proximate to the first end; the first boss having a first boss contact surface being in a third plane and defining an inlet;

a second boss extending from the central planar portion proximate to the second end; the second boss having a second boss contact surface being in the third plane and defining an outlet; and a first end first rib extending from the peripheral edge portion at the first end to the central planar portion, the first end first rib contacting the third end and fourth end of the central planar portion, the first end first rib having a first end first rib mating surface being in the third plane;

wherein the first plane is in between the second plane and third plane.

14. The heat exchanger plate according to claim 13, wherein the first end first rib is formed as a single rib or by a plurality of rib portions.

15. The heat exchanger plate according to claim 13, wherein the first end first rib has a generally U-shaped structure.

16. The heat exchanger plate according to claim 14, wherein the first end first rib is formed by a plurality of rib portions, each of the plurality of rib portions having an arcuate profile, with the concave face of one of the rib portions of the plurality of rib portions facing the first end of the central planar portion and the concave face of second and third rib portions of the plurality of rib portions facing the third end and the fourth end of the central planar portion.

17. The heat exchanger plate according to claim 13, further comprising a second end first rib.

18. The heat exchanger plate according to claim 17, wherein the second end first rib is formed as a single rib or by a plurality of second rib portions.

19. The heat exchanger plate according to claim 13, further comprising one or more dimples on the central planar portion.

20. The heat exchanger plate according to claim 19, wherein the dimples are positioned proximate to the first boss and/or second boss.

* * * * *